US006072975A

United States Patent [19]

Kyung

[11] Patent Number: 6,072,975

[45] Date of Patent: Jun. 6, 2000

[54] DEVELOPER FOR IMAGE PRODUCING APPARATUS UTILIZING ELECTROPHOTOGRAPHIC DEVELOPING TECHNOLOGY

[75] Inventor: Myung-Ho Kyung, Suwon, Rep. of Korea

[73] Assignee: SamSung Electronics Co., Ltd., Suwon, Rep. of Korea

[21] Appl. No.: 09/039,465

[22] Filed: Mar. 16, 1998

[30] Foreign Application Priority Data

Mar. 14, 1997 [KR] Rep. of Korea ..... 97/8618

[51] Int. Cl.[7] ..... G03G 15/08

[52] U.S. Cl. ..... 399/281; 399/285

[58] Field of Search ..... 399/279, 281, 399/283, 285

[56] References Cited

U.S. PATENT DOCUMENTS 4,395,113 7/1983 Buchan et al. .
4,711,549 12/1987 Roodbeen .
4,862,224 8/1989 Ku .
4,963,944 10/1990 Tange .
5,057,871 10/1991 Hirose et al. .
5,107,303 4/1992 Miyamoto et al. .
5,300,990 4/1994 Thompson .
5,329,344 7/1994 Gerbasi et al. .
5,469,247 11/1995 Cheng et al. .
5,495,322 2/1996 Wada et al. ..... 399/285
5,532,795 7/1996 Tatsumi et al. .
5,543,906 8/1996 Kanda .
5,606,408 2/1997 Yano et al. .
5,617,194 4/1997 Morishita et al. .
5,625,442 4/1997 Seki .
5,678,134 10/1997 Miki et al. .
5,701,570 12/1997 Takuma .
5,708,942 1/1998 Sugiyama et al. .

*Primary Examiner*—Matthew S. Smith
*Assistant Examiner*—Greg Muldafsky
*Attorney, Agent, or Firm*—Robert E. Bushnell, Esq.

[57] ABSTRACT

A developer and development process for use in an image formation apparatus employing electrophotographic developing technology. In the developer, a reset roll may be positioned around the toner feeding roll so as to come into contact with a toner feeding roll, thus getting the remaining toner from the surface of the toner feeding roll so as to clean the toner feeding roll. A cleaning blade is positioned with its edge coming into contact with the surface of the reset roll, thus removing the remaining toner from the reset roll. The developer almost completely prevents any deterioration of expected operational function of a toner feeding roll even when the developer is used for a lengthy period of time, thereby effectively preventing any reduction in the image quality of processed papers due to such a deterioration of the toner feeding roll's operational function.

21 Claims, 3 Drawing Sheets

DEVELOPER FOR IMAGE PRODUCING APPARATUS UTILIZING ELECTROPHOTOGRAPHIC DEVELOPING TECHNOLOGY

CLAIM FOR PRIORITY

This application makes reference to, incorporates the same herein, and claims all benefits accruing under Title 35 U.S.C. §119 from my earlier filing of a patent application entitled Developer For Image Producing Apparatus Utilizing electrophotographic Developing Technology in the Korean Industrial Property Office on the 14th day of Mar. 1997, and there duly assigned Ser. No. 1997/8618.

BACKGROUND OF THE INVENTION

1. Field of the Invention

The present invention relates generally to image formation processes and apparatus using electrophotographic developing technology and, more particularly, to a developer preferably used in such processes and apparatus while using contact-type, single component and non-magnetic developing technology capable of developing an image by applying non-magnetic toner onto an electrostatic latent image that has been formed on the exterior circumferential surface of a photosensitive drum.

2. Description of the Prior Art

As well known to those skilled in the art, electrophotographic developing technology has been effectively and widely used in various picture producing apparatus, such as copying machines, laser beam printers, and plain paper facsimiles for converting optical image signals bearing data corresponding to images onto a tangible medium such as a cut sheet of paper. These images are processed with electrophotographic developing technology by a sequence of electrification, exposure, development, transcription and fixation on the printed medium. The engine mechanism of a typical example of a picture producing apparatus using an electrophotographic developing technique includes a photosensitive drum, a developer and a transfer roll. The developer usually has an electrifying roll, a developing roll, a toner feeding roll, a toner regulating blade and a toner agitator.

The agitator is installed in the toner tank of the developer and agitates new and remaining toner at a position around both the developing and feeding rolls, thus effectively mixing the new toner and the remaining toner together. The toner, applied on the developing roll, is regulated by the toner regulating blade. Toner on the developing roll is moved and attached to the exposure area of the photosensitive drum due to static electricity formed by a potential difference between the exposing potential of the drum and the developing potential of the roll, thus developing an image.

During the operation of the printer, the toner on the developing roll is partially moved onto the photosensitive drum. The toner on the developing roll is partially used at every revolution of the roll while the remaining toner kept on the roll remains unused. The developer is designed to remove the remaining toner from the developing roll by the rotation of a toner feeding roll at the nip between the two rolls after every revolution of the developing roll. When a developer is used for a lengthy period of time, however the expected operational function of the toner feeding roll may be deteriorated due to frictional abrasion of the roll's surface or an infiltration of the sponge used to make the roll's circumferential surface. In such a case, the toner feeding roller may fail to effectively remove such remaining toner from the developing roll, allowing the remaining toner to be frictionally electrified again at the nip between the developing roll and the feeding roll prior to being reused in a continued development step. Therefore, the frictional electrification of the developer for the toner may be reduced and fail to allow uniform distribution of the electrified bias voltage for each part of the developer, thereby reducing the quality of images printed upon each sheet of paper. Various schemes have been advocated in the art such as the Fixing Device Having A Cleaning Blade of Takayuki Seki, U.S. Pat. No. 5,625,442; the Cleaning Device For An Image Forming Apparatus of Motoharu Miki et alii, U.S. Pat. No. 5,678,134; the Image Forming Apparatus Employing Residual Toner Recovery Scheme of Yasuo Takuma, U.S. Pat. No. 5,701,570; and the Developing Device For An Image Forming Apparatus of Toshihiro Sugiyama, et alii, U.S. Pat. No. 5,708,942. Invariably, these schemes require modification, albeit however minor, of the operational sequence of the developer, and tend to lack backward compatibility enabling use of the developer, with a pre-existing image formation apparatus.

SUMMARY OF THE INVENTION

Accordingly, it is an object of the present invention to provide an improved image formation apparatus and process.

It is another object to provide an apparatus and process for retarding deterioration of the expected operational function of the toner feeding roller in the developer of an image formation apparatus even after the developer has used for a lengthy period of time.

It is still another object to provide an apparatus and process able to effectively minimize reduction in the quality of successive images printed by an image formation apparatus during the process onto paper by minimizing deterioration of the operational function of the toner feeding roller.

It is yet another object to provide an apparatus and process that assures backward compatibility between a currently existing image formation apparatus and a developer able to retard deterioration of the expected operational functions of the toner feeding roller in the developer even after the developer has been used for a lengthy period of time.

It is also an object to provide a developer and development process for a picture producing apparatus utilizing an electrophotographic developing technology, which almost completely prevents any deterioration of expected operational function of a toner feeding roller even when the developer is used for a lengthy period of time, thus effectively preventing any reduction in the image quality of processed papers due to such a deterioration of the toner feeding roller's operational function.

In order to accomplish the above object, the present invention provides a process and developer for image producing apparatus utilizing an electrophotographic developing technology. The process may be performed with a developer constructed with, inter alia, a reset roller positioned around the toner feeding roller so as to be brought into contact along a nip formed with the toner feeding roller, thus receiving the residual toner from the surface of the toner feeding roller so as to clean the toner feeding roller, and a cleaning blade positioned with an edge coming into contact with the surface of the reset roller to remove the remaining toner from the reset roller.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
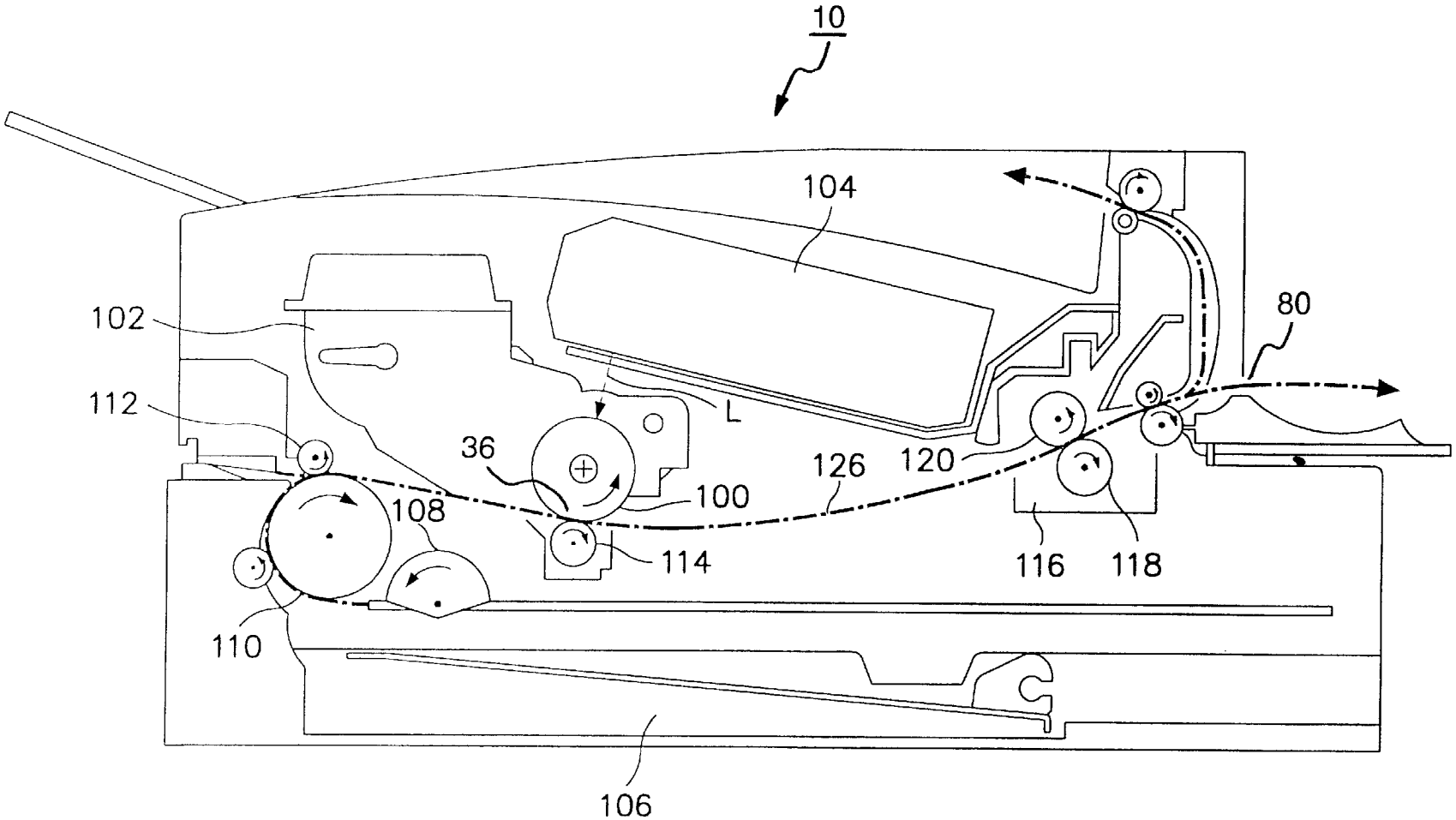
FIG. 1 is a view showing the construction of an engine mechanism of a typical laser beam printer as an example of an image formation apparatus that uses electrophotographic developing technology, suitable for the practice of the instant invention.
Figure 2:
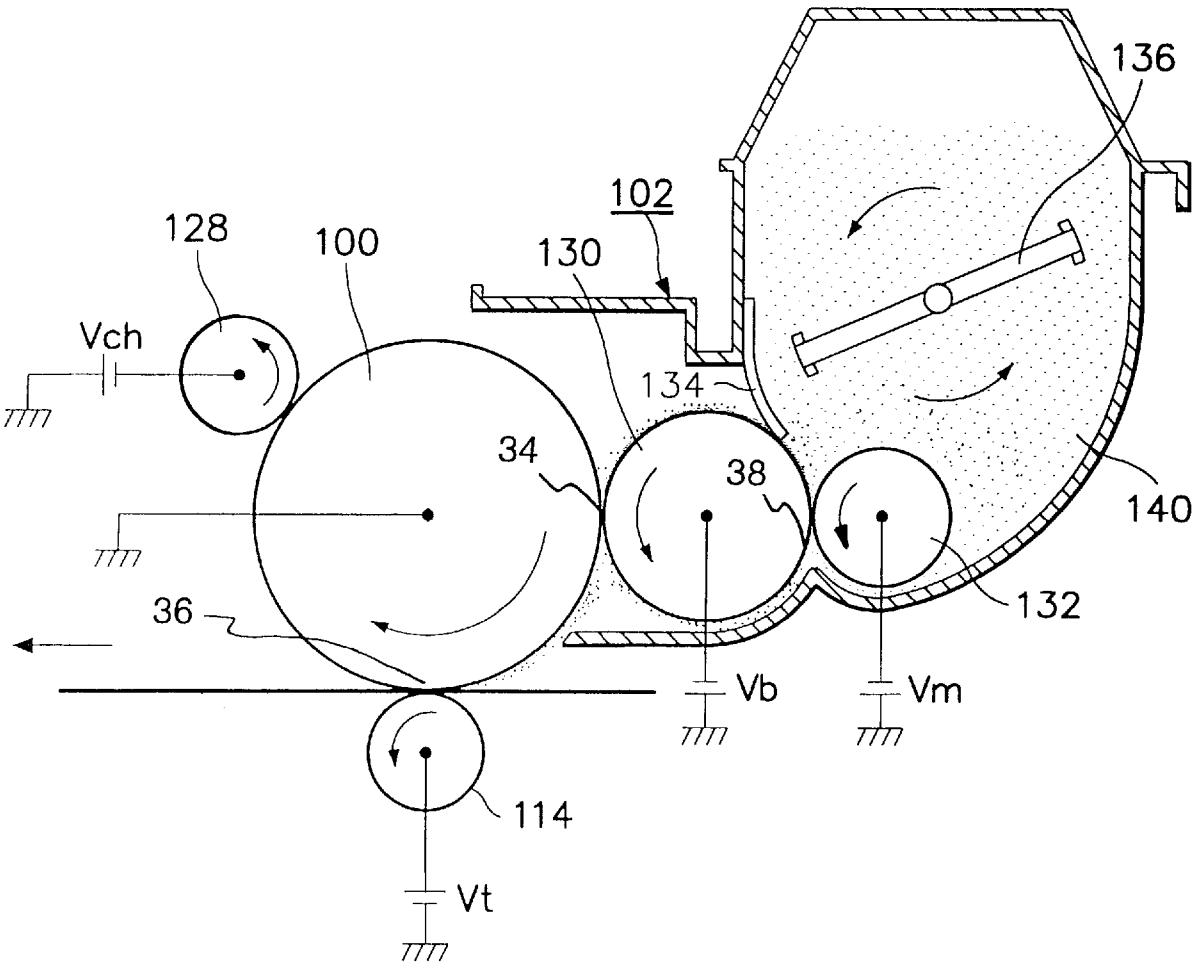
FIG. 2 is a cross-sectional schematic view showing the construction of a typical developer that may be included within the image formation apparatus illustrated by FIG. 1, with indications of the application of bias voltages for the several parts of the developer.

Turning now to the drawings, FIG. 1 schematically shows the construction of an engine mechanism of a typical laser beam printer (LBP) 10 that is used in this description as an apt example of one type of picture producing apparatus that uses electrophotographic developing technology, while FIG. 2 shows both the construction of a developer frequently included within a laser beam printer of the type shown by FIG. 1. The electrification of bias voltages for the several parts of the developer are also shown in FIG. 2. As shown in these drawings, the laser beam printer includes a photosensitive drum 100, a developer 102 and a transfer roller 114. The developer 102 may be constructed with an electrifying roller 128, a developing roller 130, a toner feeding roller 132, a toner regulating blade 134 and a toner agitator 136, as may be best seen in FIG. 2. During the course of a printing operation by such a laser beam printer, photosensitive drum 100, the rollers 114, 128, 130, 132, and agitator 136 typically receive rotation force from a drive motor through a power transmission mechanism (not shown), and are thus rotated clockwise or counterclockwise, as shown by the arcuate arrows in FIG. 2, during the course of performing the printing process. During the printing operation, individual cut sheets of paper are orderly fed serratim from a paper cassette 106 to follow a passage 126 while passing along a path of conveyance through the image formation apparatus prior to being finally discharged from the laser beam printer through a paper outlet 80.

In the above operation of the laser beam printer, the developer 102 performs an electrophotographic developing process as follows. As is described in the foregoing paragraphs, such an electrophotographic developing process is carried out in the order of electrification, exposure, development, transcription and fixation. In the electrification step, the photosensitive drum 100 is electrified with a negative bias voltage Vch, for example, about −1.4 kV, by the electrifying roller 128, thus uniformly having negative electric potential of about −800 V on its surface. The electrified surface of the drum 100 is, thereafter, subjected to an exposure step as the drum 100 is rotated. That is, the electrified surface of the drum 100 is exposed to a laser scanner unit (LSU) 104 in accordance with image data, thus forming an electrostatic latent image thereon. In such a case, unexposed areas on the drum's surface maintain a negative electric potential (−800 V) without any change, thus forming image-free areas. Meanwhile, the electric potential of exposed areas on the drum's surface is reduced from −800 V to a less negative voltage of several tens of volts. The exposed areas of the drum's surface, with the electrostatic latent image, reaches a developing area 34 due to the rotation of the drum 100. The developing area 34 means the nip between the photosensitive drum 100 and the developing roller 130 at which the development step is performed.

Within developing area 34, the electrostatic latent image on the drum's surface is developed. That is, the latent image of the drum 100 is developed by toner carried by developing roller 130, thus changing the electrostatic latent image into a visual image borne on the exterior circumferential. At a position around the developing roller 130, the toner feeding roller 132 is installed so as to be brought into contact with the developing roller 130. The toner feeding roller 132 frictionally electrifies toner from toner tank 140 of developer 102 and uniformly applies the toner onto the exterior circumferential surface of the developing roller 130. The toner feeding roller 132 also gets remaining toner on its surface from the developing roller 130 at every revolution of the roller 130, thus removing residual toner from the developing roller 130 as will be described in detail later herein. The agitator 136 is installed inside toner tank 140 of developer 102 and circulates toner inside toner tank 140. Agitator 136 also agitates new toner together with residual toner returned to tank 140 into position around both the developing and feeding rollers 130, 132, thus effectively mixing the new toner and the residual toner together within toner tank 140. In such a case, the term "residual toner" generally designates the particles of toner that remains on the surface of developing roller 130 after each revolution of roller 130, while the term "new toner" designates the toner that is newly applied onto the exterior circumferential surface of the developing roller 130 by toner feeding roller 132.

In such a case, developing roller 130 is electrified with a negative bias developing voltage Vb, for example, about −300 V, thus having a negative developing potential on its surface. Meanwhile, toner feeding roller 132 is electrified with a negative bias voltage Vm, for example, about −500 V. A potential difference exists between the negative bias voltages applied onto the developing and toner feeding rollers 130 and 132; the toner on the feeding roller 132 is frictionally electrified with a negative voltage and is moved onto the developing roller 130 by a developing force due to the significantly lower magnitude of the negative potential borne by the exterior circumferential surface of developing roller 130 relative to toner feeding roller 132. The toner applied onto the exterior circumferential surface of the developing roller 130, is regulated by the toner regulating blade 134, to assure that the toner is applied with a uniform thickness. The toner on developing roller 130 is thereafter, moved and attached to the exposed circumferential area of photosensitive drum 100 due to static electricity formed by a potential difference between the potential the areas of the exposed image on the exterior circumference of drum 100 and the developing potential of the roller 130, thus developing an image. These image development techniques in which the surface of the photosensitive drum 100 is brought into contact with the surface of the developing roller 130 for image development, is called contact-type developing technique. Specifically, when non-magnetic, polymerized toner is exclusively used in such a contact-type developing technique, the technique is called a contact-type, single component and non-magnetic developing technique.

In the operation of a laser beam printer, a sheet of paper is fed from paper cassette 106 by pick-up roller 108, and is primarily lined up at its leading edge by roller 110 and roller 112 prior to being fed to the transfer roller 1 14 through the paper passage. After a lapse of time, the leading edge of the paper reaches the nip 36 between photosensitive drum 100 and transfer roller 114 at which time the step of transcription of the developed image onto the sheet of paper is performed. That is, when the photosensitive drum 100 is rotated farther after the exposure and development steps, thus reaching the transcription area, transcription is started. During transcription, transfer roller 114 is electrified with a positive bias transfer voltage Vt of several hundred or several thousand kV, thereby causing a potential difference between the photosensitive drum 100 and the transfer roller 114 and generating static electricity within transcription area 37 (see FIG. 3) between nip 34 and nip 36. Due to the static electricity in the transcription area, the toner is transferred from the exterior circumferential surface of photosensitive drum 100 onto the surface of the sheet of paper, thus accomplishing the step of transcription. The sheet of paper, with the transferred toner, is, thereafter, pressurized and heated by pressure roller 118 and heat roller 120 of fixing unit 116 respectively. The toner is thus fixed onto the surface of the sheet of paper and produces an image on exposed surface of the sheet of paper. The sheet of paper discharged from fixing unit 116, is distributed from paper outlet 80 of the printer. This sequence of electrification, exposure, development, transcription and fixation steps are sequentially performed until a printing process for each paper is completed.

During the operation of the printer, the toner on developing roller 130 is partially moved onto photosensitive drum 100 at positions corresponding to the exposed areas on the circumferential surface of photosensitive drum 100. That is, the toner on developing roller 130 is only partially used at every revolution of developing roller 130, while the remaining toner remains unused on the exterior circumferential surface of roller 130. Developer 102 is designed however, to remove the residual toner from the surface of developing roller 130 by toner feeding roller 132 at the nip 38 between the two rollers 130 and 132 after each revolution of developing roller 130. That is, the remaining toner is transferred from developing roller 130 onto toner feeding roller 132, thus effectively cleaning developing roller 130 after each revolution. I have found that when developer 102 is used for a lengthy period of time, the expected operational function of toner feeding roller 132 may deteriorate due to the frictional abrasion of the roller's surface or the infiltration of toner into the foamed sponge forming the roller's surface. In such a case, the toner feeding roller 132 may fail to effectively remove such remaining toner from the developing roller 130, allowing the remaining toner to be frictionally electrified again at the nip between the developing roller 130 and the feeding roller 132 prior to being reused in a continued development step. Therefore, the frictional electrification performance of the developer for the toner may be reduced and fail to accommodate uniformly distribution of the electrified bias voltage for each part of the developer, thus reducing image quality of processed papers.

Figure 3:
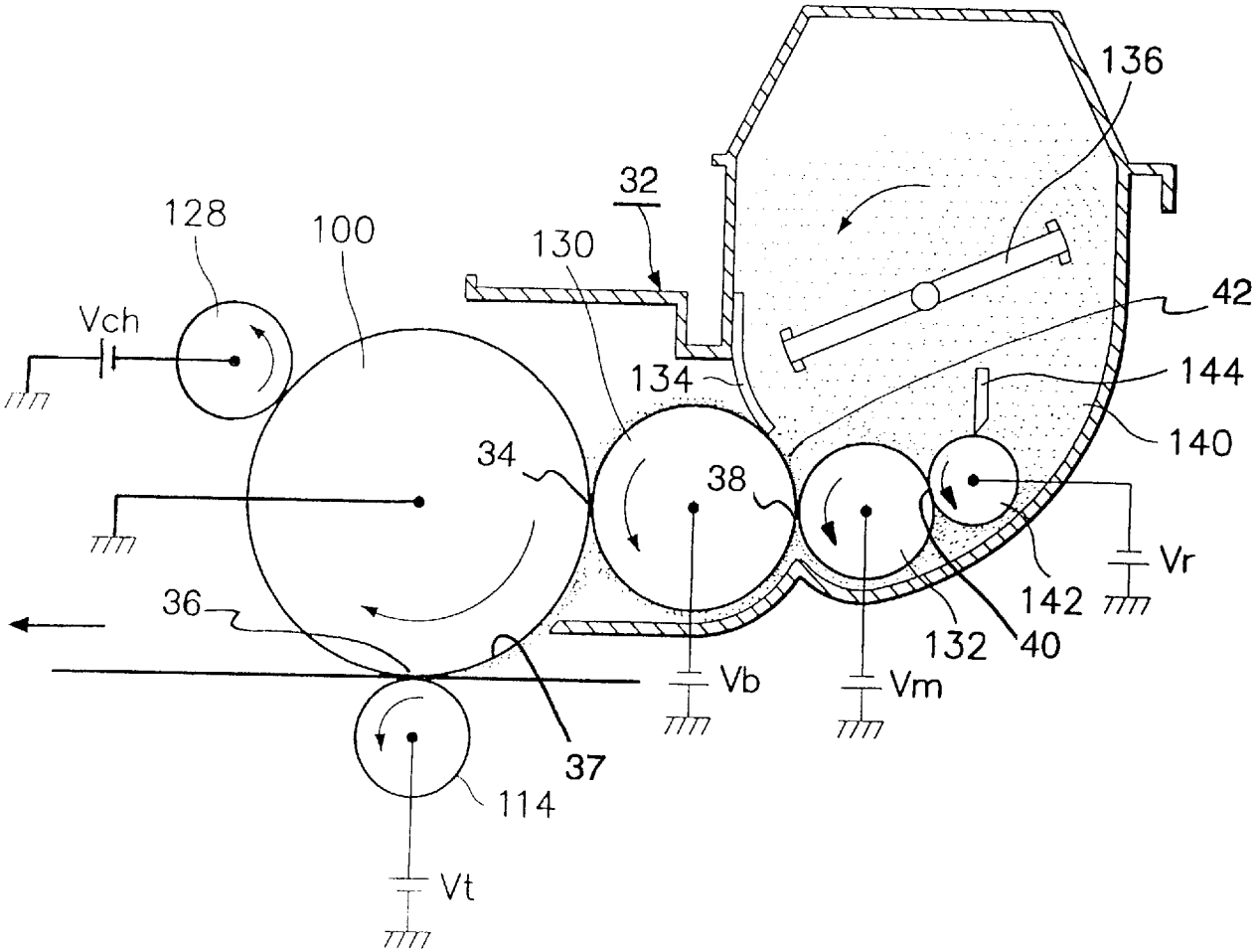
FIG. 3 is a cross-sectional schematic view illustrating the construction of a developer for the practice of the principles of the present invention while using an image producing apparatus such as that illustrated by FIG. 1 in accordance with the principles of the present invention, and illustrating the application of bias voltages for the several parts of the developer.

FIG. 3 illustrates in a cross-sectional view, both the construction of a developer suitable for use in an image formation apparatus in accordance with the principles of the present invention and the electrical connections and polarities of bias voltages relative to a reference potential such as a local ground that are applied to the several parts of the developer. As shown in the drawing, the construction of the developer 32 of this embodiment may remain generally the same as in developer 102 illustrated in FIG. 2, and may have the same size and exterior dimensions as developer 102, thereby assuring backward compatibility with image formation apparatus designed to accommodate developer 102. Therefore, the same components of developer 102 included in developer 32 in FIG. 3 are denoted by the same reference numerals and further explanation is not deemed necessary. Developer 32 is provided with both a reset roller 142 and a cleaning blade 144 that are positioned at locations around toner feeding roller 132 that are different from construction of a typical developer.

In developer 32, toner feeding roller 132 is positioned inside toner tank 140 and is separated by orifice 42 from developing roller 130. Toner feeding roller 132 is installed so as to be brought into contact with developing roller 130 and is used to frictionally electrify toner from toner tank 140 of developer 32 while uniformly applying the toner onto the surface of developing roller 130. Toner feeding roller 132 also receives residual toner on its exterior circumferential surface from developing roller 130 on each revolution of developing roller 130 in order to remove the residual toner from developing roller 130. On the other hand, reset roller 142 is installed at a location to contact the circumferential exterior surface of toner feeding roller 132 at a position that is approximately diametrically opposite to the exterior circumferential surface of developing roller 130 and is brought into contact with the exterior circumferential surface of toner feeding roller 132 with a nip 40 being formed between the exterior circumferential surfaces of toner feeding roller 132 and reset roller 142. Reset roller 142, which is at the nip 40 moving in a direction the same as the direction of travel of toner feeding roller 132, that is, reset roller 142 which has the same direction of rotation as the direction rotation of toner feeding roller 132, is used for removing the residual toner from toner feeding roller 132 after the residual toner has been moved from developing roller 130 onto feeding roller 132.

During transcription, transfer roller 114 may be electrified with a positive bias transfer voltage Vt of several hundred or several thousand kV while the central axle of photosensitive drum 100 is maintained at a reference potential such as a local ground (i.e., a ground potential relative to the bias voltages of Vch, Vt and Vb), thereby causing a potential difference between the photosensitive drum 100 and the transfer roller, 114 and generating static electricity (e.g., with a potential difference relative to the local ground of approximately −800 volts) within transcription area 37 between nip 34 and nip 36. Due to the static electricity in transcription area, the toner is transferred from the exterior circumferential surface of photosensitive drum 100 onto the surface of the sheet paper, thus accomplishing the step of transcription. Reset roller 142 may be electrified with a low level negative bias voltage Vr, for example, about −100 V, which is substantially lower than the absolute value of the magnitude of bias voltage Vm (e.g., approximately −500 volts) applied to the exterior circumferential surface of toner feeding roller 132. Therefore, the remaining toner of feeding roller 132 is effectively moved onto reset roller 142 due to a potential difference between to rollers 132 and 142, thus keeping feeding roller 132 clean. Cleaning blade 144 is positioned with the edge of blade 144 coming into direct contact with the exterior circumferential surface of reset roller 142, thus removing the remaining particles of residual toner from reset roller 142.

During the operation of developer 32, residual toner borne by toner feeding roller 132 is almost completely moved onto reset roller 142 which is, in turn, continuously cleaned by the engagement of the tip of cleaning blade 144 directly against an axial length of the exterior circumferential surface of reset roller 142. The circumferential surface of toner feeding roller 132 is thus always kept clean; consequently feeding roller 132 is enabled to effectively maintain its expected operational function, such as frictional electrification of toner at nip 38 between developing roller 130 and feeding roller 132, and removal of residual toner from the exterior circumferential surface of developing roller 130.

Therefore, even when the developer 102 is used for a lengthy period of time, toner feeding roller 132 is free from most frictional abrasion of the roller's exterior circumferential surface and from substantial infiltration of toner into the roller's sponge rubber surface, thus maintaining its expected operational function. Toner feeding roller 132 thus effectively removes remaining toner from the developing roller 130 during the operation of image producing apparatus, thereby improving the frictional electrification performance of the developer 102 relative to the toner and uniformity of the electrified bias voltage on each part of the developer, all of which contribute to the overall improvement of image quality of papers printed by the apparatus.

As described above, the present invention provides a developer suitable for use with electrophotographic developing techniques incorporated into processes and apparatus while using contact-type, single component and non-magnetic toner to develop images by applying the non-magnetic toner onto electrostatic latent images that have been formed on the exterior circumferential surface of a photosensitive drum. The developer constructed according to the principles of this invention almost completely retard deterioration of the expected operational function of the toner feeding roller even after the developer has used for a lengthy period of time, thus effectively preventing any reduction in the quality of images printed by the apparatus during the process onto paper by minimizing deterioration of operational function of the toner feeding roller.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A developer for an image producing apparatus, utilizing an electrophotographic developing technology capable of developing an image by applying non-magnetic toner from a developing roller to an electrostatic latent image on a photosensitive drum, comprising:

a toner feeding roller positioned around said developing roller to be brought into contact with the developing roller, said toner feeding roller frictionally electrifying the toner so as to apply the toner to the surface of the developing roller, and cleaning the developing roller by receiving residual toner from the developing roller during revolution of said developing roller;

a reset roller positioned around said toner feeding roller and brought into contact with the toner feeding roller, said reset roller cleaning the toner feeding roller by receiving the residual toner from said toner feeding roller;

a cleaning blade positioned with an edge in contact with the surface of said reset roller, to remove the residual toner from said reset roller;

a first terminal for applying to said toner feeding roller an electrical potential exhibiting a first absolute magnitude; and a second terminal for applying to said reset roller an electrical potential exhibiting a second absolute magnitude, wherein said second absolute magnitude is less than said first absolute magnitude.

2. The developer of claim 1, wherein said reset roller and said toner feeding roller rotate in the same direction.

3. The developer of claim 1, further comprised of:

a third terminal for applying to said developing roller an electrical potential exhibiting a third absolute magnitude, wherein said third absolute magnitude is greater than said second absolute magnitude and less than said first absolute magnitude.

4. A developer for an image producing apparatus, utilizing an electrophotographic developing technology capable of developing an image by applying non-magnetic toner from a developing roller to an electrostatic latent image on a photosensitive drum, comprising:

a toner feeding roller positioned around said developing roller so as to be brought into contact with the developing roller, said toner feeding roller being adapted for frictionally electrif ying toner with a negative bias voltage so as to apply the toner to the surface of the developing roller, and getting remaining toner from the surface of the developing roller at every revolution of said developing roller so as to clean the developing roller;

a reset roller positioned around said toner feeding roller so as to be brought into contact with the toner feeding roller, said reset roller being electrified with a low level negative bias voltage which is less than the negative bias voltage of the toner feeding roller, thus getting the remaining toner from the surface of the toner feeding roller due to a potential difference between the toner feeding roller and said reset roller and thereby cleaning the toner feeding roller; and a cleaning blade positioned with an edge in contact with the surface of said reset roller, to remove the remaining toner from said reset roller.

5. The developer according to claim 4, wherein said reset roller and said toner feeding roller rotate in the same direction.

6. The developer of claim 4, further comprised of:

a first terminal for applying to said developing roller an electrical potential exhibiting a first absolute magnitude;

a second terminal for applying to said toner feeding roller an electrical potential exhibiting a second absolute magnitude, wherein said second absolute magnitude is greater than said first absolute magnitude; and a third terminal for applying to said reset roller an electrical potential exhibiting a third absolute magnitude, wherein said third absolute magnitude is less than said first absolute magnitude, and wherein said third absolute magnitude is less than said second absolute magnitude.

7. An electrostatic developer, comprising:

a tank having an orifice oriented to discharge non-magnetic toner;

a developing roller having an exterior circumferential surface positioned within said orifice to transport the non-magnetic toner emanating from said tank onto an exterior circumferential surface of a photosensitive drum bearing an electrostatic latent image;

a toner feeding roller positioned inside said tank and separated from said developing roller by said orifice, said toner feeding roller having an exterior circumferential surface positioned to make tangential contact with said developing roller, said toner feeding roller frictionally electrifying the non-magnetic toner so as to apply the non-magnetic toner to said exterior circumferential surface of said developing roller, and receiving residual toner from said developing roller during revolution of said developing roller;

a reset roller separated from said developing roller by said toner feeding roller, said reset roller having an exterior circumferential surface positioned to make tangential contact with said toner feeding roller and to convey the residual toner from said toner feeding roller;

a cleaning blade positioned inside said tank with an edge in contact with said exterior circumferential surface of said reset roller to remove the residual toner from said reset roller;

a first terminal applying to said toner feeding roller an electrical potential exhibiting a first absolute magnitude: and a second terminal applying to said reset roller an electrical potential exhibiting a second absolute magnitude, wherein said second absolute magnitude is greater than said first absolute magnitude.

8. The electrostatic developer of claim 7, further comprised of said reset roller rotating in a direction identical to said toner feeding roller.

9. The electrostatic developer of claim 7, further comprised of an agitator rotatably mounted within said tank and spaced apart from said reset roller.

10. The electrostatic developer of claim 7, further comprised of:

a third terminal for applying to said developing roller an electrical potential exhibiting a third absolute magnitude, wherein said third absolute magnitude is greater than said second absolute magnitude and less than said first absolute magnitude.

11. The electrostatic developer of claim 7, further comprised of said toner feeding roller rotating in a direction the same as said developing roller.

12. The electrostatic developer of claim 7, further comprised of:

said toner feeding roller rotating in a direction the same as said developing roller; and said reset roller rotating in a direction the same as said toner feeding roller.

13. An electrophotographic developer, comprising:

a photosensitive drum rotating in a first direction;

a developing roller in contact with said photosensitive drum, said developing roller rotating in a second and opposite direction to said photosensitive drum;

a toner feeder roller placed in contact with said developing roller and in a location diametrically opposite from said photosensitive drum, said toner feeder roller rotating in said second direction; and a reset roller placed in contact with said toner feeder roller, said reset roller positioned in a location diametrically opposite from said developing roller, said reset roller rotating in said second direction being.

14. The electrophotographic developer of claim 13, further comprising a cleaning blade with an edge in contact with the surface of said reset roller, to remove remaining toner from said reset roller.

15. The electrophotographic developer of claim 13, further comprising a tank having an orifice oriented to discharge non-magnetic toner.

16. The electrophotographic developer of claim 13, wherein said developing roller, said toner feeder roller, and said reset roller each have a separate voltage applied thereto.

17. A method for cleaning residual toner from a developing roller in an electrophotographic apparatus, comprising the steps of:

rotating a toner feeder roller in the same direction as said developing roller, said toner feeder roller being in contact with said developing roller, said developing roller having a first voltage having a first magnitude, said toner feeder roller having a second voltage having a second magnitude which is greater than the first magnitude of the first voltage applied to said developing roller, said toner feeder roller removing residual toner from said developing roller; and rotating a reset roller in the same direction as said developing roller and said toner feeder roller, said reset roller being in contact with said toner feeder roller at a location on said toner feeder roller that is diametrically opposite to a point of contact between said developing roller and said toner feeder roller, said reset roller having a third voltage having a third magnitude which is less than the first magnitude of the first voltage applied to said developing roller, said reset roller removing the residual toner from said toner feeder roller.

18. The method of claim 17, further comprising the step of scraping off residual toner on said reset roller by having a cleaning blade positioned with an edge in contact with the surface of said reset roller, to remove the residual toner from said reset roller.

19. A developer for an image producing apparatus, utilizing an electrophotographic developing technology capable of developing an image by applying non-magnetic toner from a developing roller to an electrostatic latent image on a photosensitive drum, comprising:

a toner feeding roller positioned around said developing roller to be brought into contact with the developing roller and forming a nip, said nip frictionally electrifying the toner so that the toner is applied to the surface of the developing roller, and cleaning the developing roller by receiving residual toner from the developing roller during revolution of said developing roller;

a reset roller positioned around said toner feeding roller and brought into contact with the toner feeding roller, said reset roller cleaning the toner feeding roller by receiving the residual toner from said toner feeding roller;

a cleaning blade positioned with an edge in contact with the surface of said reset roller, to remove the remaining toner from said reset roller;

a first terminal for applying to said toner feeding roller an electrical potential exhibiting a first absolute magnitude; and a second terminal for applying to said reset roller an electrical potential exhibiting a second absolute magnitude, wherein said second absolute magnitude is less than said first absolute magnitude.

20. The developer of claim 19, further comprised of:

a third terminal for applying to said developing roller an electrical potential exhibiting a third absolute magnitude, wherein said third absolute magnitude is greater than said second absolute magnitude and less than said first absolute magnitude.

21. The developer of claim 19, wherein said reset roller and said toner feeding roller rotate in the same direction.

* * * * *